US007559673B2

(12) United States Patent
Meersman et al.

(10) Patent No.: US 7,559,673 B2
(45) Date of Patent: Jul. 14, 2009

(54) METHOD AND DEVICE FOR SHADING IN A DISPLAY SYSTEM

(75) Inventors: Karim Meersman, Kortemark (BE); Aaron Beddes, Kuurne (BE); Katrien Noyelle, Gullegem (BE)

(73) Assignee: Barco N.V., Kortrijk (BE)

( * ) Notice: Subject to any disclaimer, the term of this patent is extended or adjusted under 35 U.S.C. 154(b) by 0 days.

(21) Appl. No.: 11/651,477

(22) Filed: Jan. 10, 2007

(65) Prior Publication Data

US 2007/0165162 A1 Jul. 19, 2007

Related U.S. Application Data

(60) Provisional application No. 60/758,602, filed on Jan. 13, 2006.

(51) Int. Cl.
*F21V 7/00* (2006.01)

(52) U.S. Cl. ..... 362/245; 362/290; 362/342; 40/542; 40/579

(58) Field of Classification Search ..... 362/24, 362/27–29, 33, 97, 133, 235, 237, 238, 245, 362/246, 279, 290, 291, 311, 342, 346, 351, 362/359, 555, 559, 611–614, 618, 619, 800, 362/812; 349/61, 62, 66, 71, 114; 345/46, 345/48, 55, 426; 40/541, 542, 550, 564, 40/565, 577

See application file for complete search history.

(56) References Cited

U.S. PATENT DOCUMENTS

| | | | | | |
|---|---|---|---|---|---|
| 3,017,713 | A * | 1/1962 | Butler | ..... | 40/615 |
| 3,978,599 | A * | 9/1976 | Berger | ..... | 40/542 |
| 4,967,317 | A * | 10/1990 | Plumly | ..... | 362/613 |
| 5,682,697 | A * | 11/1997 | Hjaltason | ..... | 40/615 |
| 6,058,634 | A * | 5/2000 | McSpiritt | ..... | 40/452 |
| 6,364,507 | B1 * | 4/2002 | Yang | ..... | 362/248 |
| 6,898,012 | B2 * | 5/2005 | Kaminsky et al. | ..... | 359/599 |
| 7,217,024 | B2 * | 5/2007 | Good et al. | ..... | 362/604 |
| 7,273,308 | B2 * | 9/2007 | Spero et al. | ..... | 362/560 |
| 7,284,881 | B2 * | 10/2007 | Kim et al. | ..... | 362/290 |

* cited by examiner

*Primary Examiner*—Hargobind S Sawhney
(74) *Attorney, Agent, or Firm*—Bacon & Thomas, PLLC

(57) ABSTRACT

A shading device is described for use with a display system. The shading device includes a first component, typically a rigid component, and a second component. The second component at least partially covers the first component. The second component is a solid continuous film which has a lower reflectivity than the first component. In a particular embodiment, the second component is more elastic or flexible than the first component and/or has a hardness smaller than the first component, and is furthermore adapted such that it can provide a sealing contact with a plurality of light sources. The latter allows using the shading device also as a sealing arrangement for sealing electronics and other components of the display system from the ambient of the display system.

14 Claims, 6 Drawing Sheets

Hardness Scale

METHOD AND DEVICE FOR SHADING IN A DISPLAY SYSTEM

TECHNICAL FIELD OF THE INVENTION

The present invention relates to systems, devices and methods for displaying information. More particularly, the present invention relates to systems, devices and methods for shading in display systems, and to such display systems or devices using such shading systems.

BACKGROUND OF THE INVENTION

Display systems are often used for displaying information in outdoor applications, such as e.g. for lighting or displaying such as in advertisement of for showing video or other information. Especially for outdoor applications, although not limited thereto, sealing of the electronics of the display system against ambient, i.e. environmental influence, and shading from other light sources typically is an important issue. A shader typically is used to block light from falling on the display system or the light source units thereof and to provide a black background which is non-reflective, e.g. in between the different light source units. Use of a shader typically results in an enhanced contrast and an improved image quality, e.g. for displaying a black image.

A first method to provide sealing and shading is to seal the electronics using a coating, e.g. a conformal coating, a silicone potting, etc. and to place a solid shader over the sealed electronics. The challenges with the first method is that because of the requirements of assembly and stability, the choice of shader materials is limited. Furthermore ideally, the shader should be rigid, environmentally curable, dark and non reflective. Polycarbonate or polyamide are the typical choice, but neither of these materials meet all the requirements.

Another, second, method to provide sealing and shading is to provide a solid shader that is integrated into the sealed assembly, leaving the cured sealing material, e.g. the silicone potting or conformal coating, exposed. The challenges of the first method also apply to the second method, wherein shaders that poke through the sealing material are used. Although the sealing material may be dark and mat, thus meeting some of the requirements for a good shader, the sealing material may pose an additional problem. The sealing material, such as e.g. silicone potting, is often not stable and over time it turns shiny. Additionally silicone is not mouldable, and it can therefore not be created with any specific texture or shape, e.g. light-trapping shape.

By way of example, a shader device being part of a display system is shown in cross section in FIG. 1. The display system 10 comprises a light source board 12, comprising a plurality of light source units 14, a heat path 16 and cooling plate 18 for cooling the device and a mounting stud 20 on which the light source board 12 is mounted. The system furthermore comprises a shading device 22 with upstanding shading parts 24, for shading the display system from direct light incidence. To seal the electronics, typically a sealing material 26 is applied, such as e.g. silicone. The edge of the display system may be masked using a black mask 28. The display system 10 shown in FIG. 1 furthermore comprises optical lenses 30 in front of the light source units 14.

SUMMARY OF THE INVENTION

It is an object of the present invention to provide good apparatus or methods for shading a display system. It is an advantage of embodiments of the present invention to provide apparatus and methods for shading that are efficient and stay efficient over a long time. It is an advantage of embodiments of the present invention that an improved contrast is obtained due to the presence of a shape overlay component that can be moulded and therefore can be given a specific texture, e.g. a matt surface, and a specific shape, e.g. a light-trapping shape. It is also an advantage of embodiments of the present invention that a material with high flexibility can be used, as the overlay material does not need to have the structural properties that the substrate needs for assembly and stability. The latter keeps the material selection open for achieving other goals, such as a high contrast, having a soft material and/or having a material with high dust repulsion. It is furthermore an advantage of embodiments of the present invention that an improved manufacturability is obtained, due to the elimination of the need for solvents, glues and due to the elimination of manual sprays that typically are used in prior-art shader-coating concepts. It is also an advantage of embodiments of the present invention that a mouldable overlay system according to embodiments of the present invention allows the optional use of a soft material leading to a reduction of the possibilities for injury when handling or otherwise coming into contact with the product. The latter may occur in sports markets or rental markets. It is also an advantage of embodiments of the present invention that the overlay material can be optionally used as a water, dust and/or air sealing material on any side of the product.

The above objective is accomplished by a method and device according to the present invention.

In a first aspect, the present invention provides a shading device for shading a display system, the shading device comprising a first component and a second component, the first component being a core component having a reflectivity and the second component at least partly covering the core component, wherein the second component is a solid continuous layer having a lower reflectivity than the core component (e.g. a black material). The second component preferably has an improved long-term black colour longevity compared to the core component. With a solid layer is meant a layer which is self-supporting. With a continuous layer is meant a layer which does not comprise discrete separate portions. It is an advantage of embodiments of the present invention that they provide a system that suffers less from flaking off compared to sprayed components.

In embodiments of the present invention, the first component may be a rigid component. The first component may be a dimensionally stable component. The first component may be made of a synthetic material such as a polymer, e.g. a polycarbonate resin.

The first component may comprise holes adapted for receiving a plurality of light source units of said display device, whereby said holes in said first component are such that the shading device is adapted for providing a spacing between said first component and said plurality of light source units.

The second component may comprise holes, thus being adapted for receiving the plurality of light source units.

According to embodiments of the present invention, the second component may be a layer provided with a microstructure to reduce reflectivity. These microstructures, either regular or irregular, may be produced by roughening a surface, e.g. by laser processing. The present invention includes modifying the roughness of the surface of the second component, e.g. to increase an existing roughness.

For example, the second component may be a film or foil provided with particles, e.g. Aluminium particles, which may be sputtered onto the film. In a particular embodiment, the film may be a metal film, provided with metal particles, optionally sputtered thereon. The layer may have a thickness of between 0.1 and 0.5 mm thick, preferably between 0.1 and 0.2 mm thick.

According to embodiments of the present invention, the second component may be more elastic or more flexible than the core component.

According to embodiments of the present invention, the second component may comprise a region with a thickness of at least 0.5 mm.

According to embodiments of the present invention, the second component may comprise an elastomeric material and/or a plastic such as polyamide.

According to embodiments of the present invention, the second component may comprise a thermoplastic elastomer material.

According to embodiments of the present invention, the second component may be tandem- or co-moulded with said first, core component.

According to embodiments of the present invention, the second component may comprise holes, thus being adapted for receiving said plurality of light source units, said second component being adapted for being in sealing contact with said plurality of light source units.

According to embodiments of the present invention, said second component may be made of an anti-electrostatic material.

According to embodiments of the present invention, the shading device may comprise portions shaped for blocking ambient light incident under predetermined angles.

According to embodiments of the present invention, the shading device may be adapted for accommodating lens elements for said display system.

In a second aspect, the present invention provides a display system for displaying an image, said display system comprising a shading device, the shading device comprising a first component being a core component, and a second component at least partly covering the core component and at least partly shielding the core component from the ambient light incident on the display system, wherein the second component is a solid continuous layer which has a lower reflectivity than the core component. The second component preferably has an improved long-term black colour longevity compared to the core component. According to embodiments of the present invention, the second component may be a layer provided with a microstructure to reduce reflectivity. This microstructure, either regular or irregular, may be produced by roughening the surface, e.g. by laser processing as described above.

According to embodiments of the present invention, the second component may be a metal film provided with metal particles. The metal particles may be sputtered onto the metal film.

According to embodiments of the present invention, the second component may be more elastic or more flexible than the core component.

According to embodiments of the present invention, the display system furthermore may comprise a plurality of light source units, wherein said second component is in sealing contact with said plurality of light source units.

According to embodiments of the present invention, the shading device may comprise portions shaped for blocking ambient light incident on said display system under predetermined angles.

According to embodiments of the present invention, the shading device may be adapted for accommodating optical elements for said display system.

In a third aspect, the present invention provides a method for manufacturing a display system, the method comprising providing a bare display system, the bare display system typically comprising a plurality of light source units, providing a shading device comprising a first rigid component and a second component having a lower reflectivity than the core component, pushing the shading device onto the bare display system such that the plurality of light source units are inserted through holes in the first component and pushed in holes of the second component of the shading device, such that the second component is in sealing contact with the plurality of light source units.

According to embodiments of the present invention, providing a shading device may comprise providing a shading device with a second component which is more elastic and/or less hard and/or more flexible than the first component.

According to embodiments of the present invention, the method may furthermore comprise fixing said shading device to said bare display system In accordance with a further aspect, the present invention relates to a shading device for shading a display system, the shading device comprising a first component and a second component, the first component being a core component and the second component at least partly covering the core component, wherein the second component is a solid continuous layer being more elastic than the core component. With a solid layer is meant a layer which is self-supporting. With a continuous layer is meant a layer which does not comprise discrete separate portions. The second component may comprise a region with a thickness of at least 0.5 mm. The second component may comprise a region with a thickness of at least 0.7 mm. The second component may comprise a region with a thickness of at least 1 mm. The thickness typically may be the layer thickness. The layer thickness may vary. It is an advantage of embodiments of the present invention that they provide a good environmental protection e.g. to organic solvents and environmental influences such as ultraviolet rays and weathering. The second material may be more easily changed in shape and may be selected to also absorb impacts.

The second component may comprise a synthetic material such as a polymer and is preferably an elastomeric material or a plastic material such as a polyamide. The second component may comprise at least 50%, more preferably 75%, even more preferably 90% of elastomeric material. The second component may consist of a synthetic material such as a polymer and is preferably elastomeric material and/or a plastic material such as a polyamide. The second component may be cross-linked or vulcanised.

The second component may comprise a thermoplastic material such as a thermoplastic polymer or a thermoplastic elastomer or rubber material. The thermoplastic elastomeric material may be a thermoplastic elastomer based on hydrogenated styrene block copolymers.

The second component may be tandem- or co-moulded with said first, core component, e.g. using an injection or transfer moulding process. Alternative processes may be used, e.g. lamination, or fabrication processes such as gluing.

It is an advantage of embodiments of the present invention that they provide a system that suffers less from environmental problems and that flakes off less compared to sprayed components. It furthermore is an advantage of embodiments according to the present invention that an easily applicable manufacturing technique can be used The second component may comprise holes, thus being adapted for receiving a plurality of light source units, said second component being adapted for being in sealing contact with said plurality of light source units. The display system may comprise a plurality of light emitting device units, e.g. a plurality of light emitting diode (LED) units or organic light emitting diode (OLED) units.

In embodiments of the present invention, the first component may be a rigid component. The first component may be a dimensionally stable component. The first component may be made of a synthetic material such as a polymer, e.g. a polycarbonate resin.

The first component may comprise holes or apertures adapted for receiving a plurality of light source units of said display device, whereby said holes in said first component are such that the shading device is adapted for providing a spacing between said first component and said plurality of light source units.

The second component may be made of an antistatic material. The material of the second component may include fillers which provide an antistatic effect. The material of the second component is preferably, black, e.g. matt black. One filler may be carbon in one of its forms, e.g. carbon black. It is an advantage of embodiments of the present invention that they prevent dust attraction, resulting in a longer lifetime of the black colour longevity for users and/or viewers of the device. The shader may provide a black background for the light sources to increase contrast while at the same time reducing glaring or reflection effects in sunlight.

The shading device may comprise portions shaped for blocking ambient light incident on the holes or apertures 116 under predetermined angles.

The shading device may be adapted for accommodating other optical elements such as lens or diffraction elements for said display system.

In a further aspect, the present invention also relates to a shading device for shading a display system, the shading device comprising a first component and a second component, the first component being a core component and the second component at least partly covering the core component, wherein the second component is a solid continuous layer having a hardness lower than the core component. Other features of the shading device may be as described for the shading device above.

The present invention furthermore relates to a display system for displaying an image, said display system comprising a shading device, the shading device comprising a first component being a core component, and a second component at least partly covering the core component and at least partly shielding the core component from the ambient of the display system, wherein the second component is a solid continuous layer being more elastic than the core component.

The display system furthermore may comprise a plurality of light source units, wherein said second component may be in sealing contact with said plurality of light source units.

Each of said light source units may comprise an encapsulation whereby the sealing contact with said plurality of light source units may be a sealing contact with the encapsulation of the plurality of light source units. The encapsulation may have a smooth outer surface suitable for sealing on. Said display system may comprise a plurality of light emitting device units, e.g. a plurality of light emitting diode (LED) units or organic light emitting diode (OLED) units.

The shading device may comprise portions shaped for blocking light incident on said display system under predetermined angles.

The shading device may be adapted for accommodating optical elements for said display system.

The present invention furthermore relates to a display system for displaying an image, said display system comprising a shading device, the shading device comprising a first component being a core component, and a second component at least partly covering the core component and at least partly shielding the core component from the ambient of the display system, wherein the second component is a solid continuous layer having better optical properties, e.g. a lower reflectivity and/or an improved long-term black colour longevity, compared to the first component. Other features of the display system may be as described for the display system above.

In a further aspect, the present invention furthermore relates to a display system for displaying an image, said display system comprising a shading device, the shading device comprising a first component being a core component, and a second component at least partly covering the core component and at least partly shielding the core component from the ambient of the display system, wherein the second component is a solid continuous layer having a hardness lower than the core component. Other features of the display system may be as described for the display system above.

In a further aspect, the present invention also relates to a method for manufacturing a display system, the method comprising providing or receiving a bare display system, the bare display system typically comprising a plurality of light source units, providing or receiving a shading device comprising a first rigid component and a second more elastic and/or less hard component, pushing the shading device onto the bare display system such that the plurality of light source units are inserted through holes in the first component and pushed in holes of the second component of the shading device, such that the second component is in sealing contact with the plurality of light source units. The method may be performed in an automated way. The method furthermore may comprise fixing said shading device to said bare display system Particular and preferred aspects of the invention are set out in the accompanying independent and dependent claims. Features from the dependent claims may be combined with features of the independent claims and with features of other dependent claims as appropriate and not merely as explicitly set out in the claims.

Although there has been constant improvement, change and evolution of devices in this field, the present concepts are believed to represent substantial new and novel improvements, including departures from prior practices, resulting in the provision of more efficient, stable and reliable devices of this nature.

The teachings of the present invention permit the design of improved methods and apparatus for displaying information or for lighting The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

Figure 1:
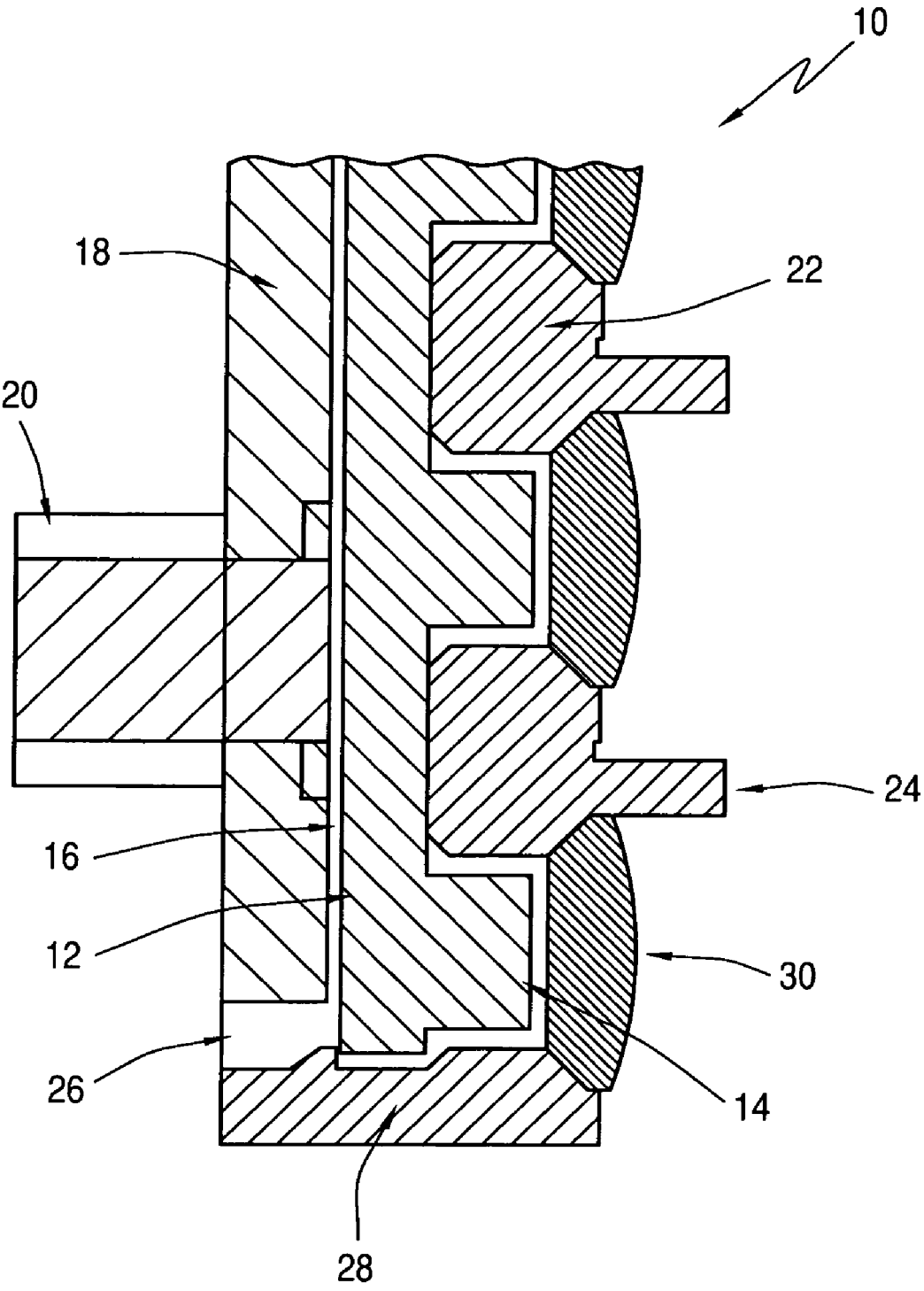
FIG. 1 (PRIOR ART)
FIG. 1 is a cross-section of part of a display system comprising a shading device as available from prior art.

In the different figures, the same reference signs refer to the same or analogous elements.

DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "coupled", also used in the claims, should not be interpreted as being restricted to direct connections only. Thus, the scope of the expression "a device A coupled to a device B" should not be limited to devices or systems wherein an output of device A is directly connected to an input of device B. It means that there exists a path between an output of A and an input of B which may be a path including other devices or means.

The invention will now be described by a detailed description of several embodiments of the invention. It is clear that other embodiments of the invention can be configured according to the knowledge of persons skilled in the art without departing from the true spirit or technical teaching of the invention, the invention being limited only by the terms of the appended claims.

In a first embodiment, the present invention relates to a shading device, e.g. a shading device for use in a display system. The shading device typically comprises a first component that is a core component having a reflectivity and a second component that is at least partly covering the core component. The second component typically is a solid continuous layer covering at least a part of the core component. With a solid layer is meant a layer which is self-supporting. With a continuous layer is meant a layer which does not comprise discrete separate portions. The solid continuous layer of the display device is preferred over a fibre based second component (which can attract dust) or a sprayed film (which may flake off). In accordance with embodiments of the present invention, the second component has a lower reflectivity than the first component. Furthermore the second component may be more elastic or more flexible than the core component and/or has a lower hardness than the core component. In other words the core component may be made of a first material and the second component may be made of a second material whereby the first material may have a higher hardness than the second material and/or the first material may be less elastic than the second material. The lower hardness of the second, outer component can provide good impact resistance and/or resistance to injury of installers or passers-by. The elasticity of the materials may e.g. be expressed by the Young elasticity modulus. The hardness typically may be expressed in a Shore hardness.

Figure 2:
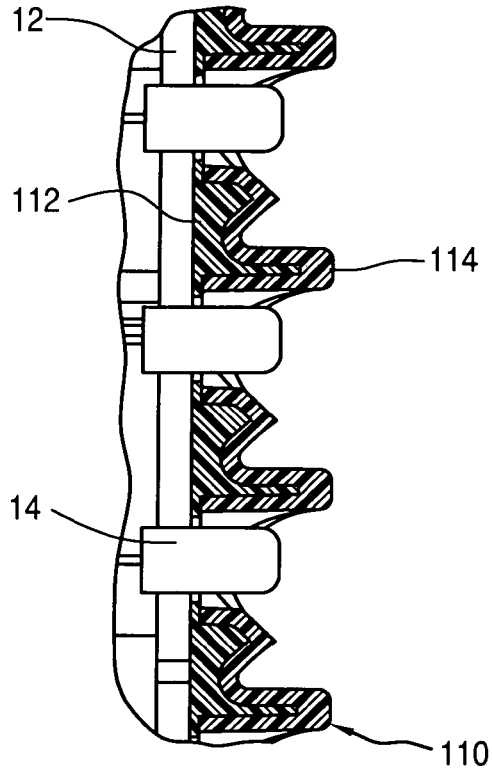
FIG. 2 is a cross-section of part of a display system with a shading device according to a first embodiment of the present invention

A schematic representation of a shading device of a first embodiment of the present invention, in the present example mounted in a display system, although the invention is not limited thereto, is illustrated in FIG. 2. FIG. 2 shows part of a display system 100 comprising a plurality of light sources 102 and a shading device 110 according to the present embodiment with a first component 112, being a core component 112, and a second component 114 at least partly covering the core component 112. The first component 112 typically is suited for facing towards the remaining parts of the display system, whereas the second component 114 typically is suited for facing outwards from the display system, i.e. facing the environment or viewing side of the display system.

The core component 112 preferably is made of a dimensionally stable material. It preferably is stiff and strong. The material preferably may be hard. A suitable material may e.g. have a hardness higher than shore D 75, e.g. a Rockwell R hardness of more than 100, e.g. a Rockwell R hardness of 115. A suitable material also may have a hardness value of about 90 Mpa determined using the ISO 2039-1 standard. A suitable material may have for example a Young modulus above 1 GPa, e.g. between 1 GPa and 2.5 GPa, or e.g. between 2 GPa and 2.5 GPA. A typical material that can be used for the core component 112, although the invention is not limited thereto, is a synthetic material such as a polymer especially a thermoplastic polymer such as a polycarbonate resin. The core component 112 furthermore may comprise good assembly properties, i.e. it may be suitable for taking fastening means, such as e.g. taking screws or snaps. In a particular embodiment, the core component 112 may be provided with means to attach the shading device to another part of a display system, such as to a light source board. Alternatively, the core component 112 may be suitable for being glued to another part of the display system, such as to a light source board. In another embodiment, a clicking or click-lock mechanism may be provided on the core component, whereby a latch attaches around part of a lighting module of the display system.

The second component 114 typically may be a solid continuous layer covering at least partly the core component 112. According to embodiments of the present invention, second component 114 may be roughened so as to reduce its reflectivity. The roughening may be done by removing a part of the surface of the second component thereby providing a regular or irregular surface pattern. According to embodiments of the method, removing a part of the second component may be done by irradiating the surface with a laser. The irradiation will cause the surface of the second component to become partially destroyed and removed. In particular laser surface processing may be used. Laser processing has the advantage that the surface may be etched while not thermally degrading the material underneath. Laser techniques for modifying the surface include laser ablation and/or laser etching.

Using a laser to remove parts of the surface of the second component is also advantageous as in such a way a pattern, be it a regular or irregular pattern, may be provided in a very accurate and precise and relatively easy way. The process step may be automated e.g. computer controlled. The method allows also the precise location of the zones to be roughened.

The use of a laser does not create a substantial amount of particles in spite of the removal of particulate matter due to evaporation and/or thermal degradation. By selection of the laser, wavelength of light used, and setting the laser processing parameters such as the use of continuous or pulsed laser light, the laser fluence etc., the etch depth and also the conversion of molecules of the second component, e.g. polymer molecules, into gaseous products such as $CO_2$, CO, $H_2O$ etc. can be controlled. Hence no negative influence of the products used or created during the process needs to be taken into account during roughening. The methods can be automated and made highly efficient and have substantially no dimensional limitations. According to embodiments of the method, radiation from a gas laser such as $CO_2$-laser may be used to irradiate the substantially transparent or translucent material, e.g. potting material for providing the optical surface along the support zone.

It was found that the use of a $CO_2$-laser roughens the surface of the second component 114 over a depth of about 10 μm, whereas less to no cutting deeper into the material was noticed. This may be done by irradiating the surface of the second component with a laser, e.g. a gas laser, preferably a $CO_2$-laser such as a 30 Watt laser marker. The roughening can be done by providing a regular or irregular pattern to the support zone of the optical surface. Alternatively a YAG-laser may be used. Laser methods and equipment for roughening or etching polymeric surfaces are known to the skilled person, e.g. from standard works such as "Lasers in Surface Engineering", ed. N. B. Dahotre, vol. 1, ASM International, 1998, especially chapter 8, "Lasers for polymeric coatings" and more especially the section on "Laser induced etching of Polymeric materials".

The method has the advantage that no additional material is to be applied, i.e. added, onto the surface of the second component to reduce the reflection of the optical surface at zones, which zones are accurately to be positioned. Hence weather or environmental conditions have little or even no effect on the roughened character of the surface, which provides long lasting and substantially constant low reflective properties.

Also other means may be used to roughen or create matt zones of the surface of the second component, such as chimerical etching, mechanical grinding, blasting, scratching, water jet treatment, grinding, brushing, and the like.

In embodiments of the present invention, the second component 114 may be a layer, a foil or a film provided with a microstructure so as to reduce its reflectivity. The textures or shapes of the microstructures may be such that light trapping may be optimally performed, i.e. specific shapes may be provided for trapping of light. As an example, the second component 114 may be a metal film provided with metal particles, such as Aluminium particles, which may be sputtered onto the film. This layer, foil or film may be attached to the first component 112, e.g. by glueing or in any other suitable way. The film may be roughened as described above to produce the microstructures, e.g. by use of a laser.

Figure 8:
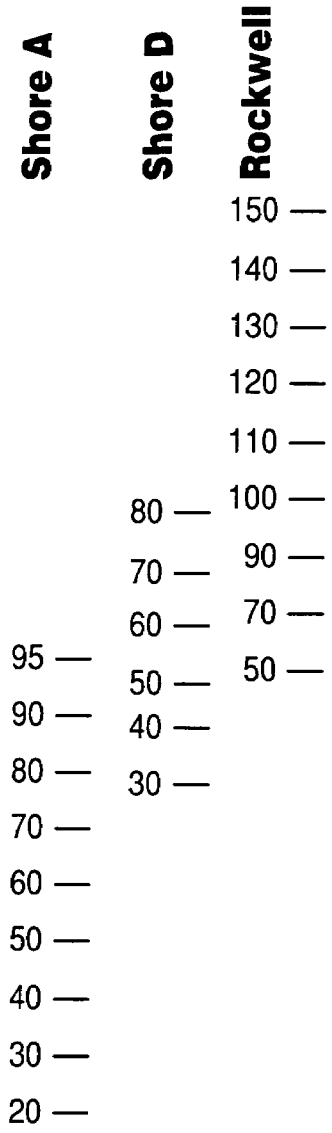
FIG. 8 is a comparison between different hardness parameters, as available from literature.

In embodiments of the present invention, this layer, foil or film forming the second component 114 may comprise a region having a thickness of at least 0.5 mm. It may even comprise a region having a thickness of at least 1 mm. The second component 114 preferably is more elastic or has a lower hardness than the core component 112. In other words it may be a softer or more rubbery material than the core component 112. The second component may have a Young's Modulus lower than 0.5 GPa, preferably lower than 0.1 GPa. For example, one type of suitable TPE may have a Young's Modulus of about 0.045 GPa. Typically, the second component 114 may be made of a synthetic material such as a polymer, e.g. be made of thermoplastic elastomer (TPE) materials or a plastic such as polyamide-like materials such as a nylon. Such materials may have a hardness within the range shore A 40 to shore D 75, as described for example in Rubber Technology Handbook by Werner Hofmann (Hanser Publishers, Munich Vienna New York, reprinted in 1996) e.g. on page 148. Different types of thermoplastic elastomer materials (TPE) such as block or segmented copolymers, elastomer-thermoplastic blends or elastomers with thermally reversible labile crosslinks materials may be used for example, styrenes (TPE-S), polyurethanes (TPE-U), Polyetheresters (TPE-E), Polyetheramides (TPE-A) or elastomeric alloys as also described in Rubber Technology Handbook. FIG. 8 illustrates a comparison between different Hardness parameters, as available from literature.

The second component preferably is a matt, non-reflective or low-reflective material, that preferably is dark, i.e. that preferably is black. The second component 114 preferably has an improved long-term black colour longevity compared to the first component 112. It is advantageous if the second component 114 is made of a mouldable material, such that specific textures and shapes can be construed. These specific textures may be textures minimising the reflectivity. The textures or shapes may be such that light trapping may be optimally performed, i.e. specific shapes may be provided for trapping of light. It is an advantage that the second component 114 can be co-moulded or tandem-moulded with the core component. The latter eases the manufacturing process.

It is advantageous if the second component is made of a soft material, compared with the first component, to avoid injury to living creatures, e.g. people, which come into contact with the shading device, e.g. installers or passers-by who bump into the display and thus contact the shading device. The softness of the material typically may be expressed by hardness values, as described above. The second component 114 also may be dust repellent or does not attract or retain dust, i.e. it may be non-electrostatic also it may be non-hairy. The latter helps for keeping long term stability of the optical properties of the material, as dust may alter the colour longevity obtained by a viewer of the shading device.

Figure 3:
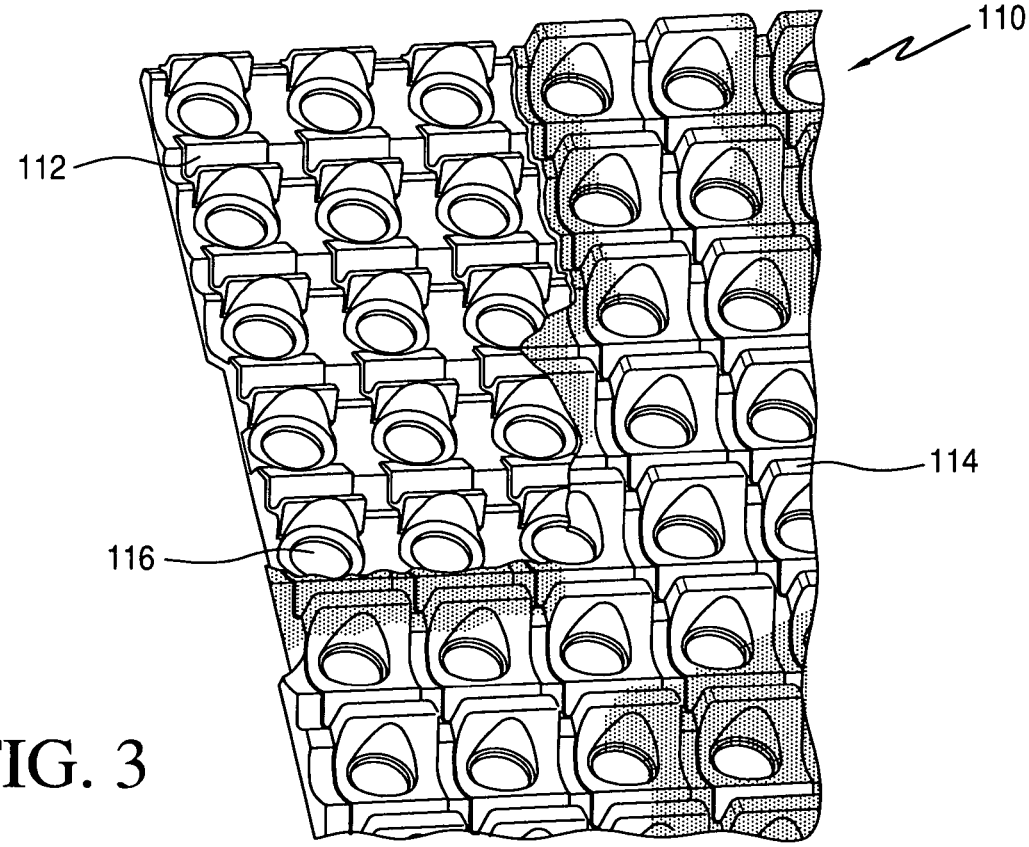
FIG. 3 is a perspective view of a shading device according to the first embodiment of the present invention, showing a part of the core component with a part of the second ? component taken away.

A top view of a schematic illustration of a shading device 110 according to the first embodiment of the present invention is shown in FIG. 3, whereby a region of the upper left is shown where the second component 114 is stripped away, thus illustrating the first component 112, and where the remaining region includes both the first component 112 and the second component 114. Furthermore, the accommodating holes or apertures 116 for accommodating the plurality of light source units are illustrated.

In another embodiment, the first component and second component of the shading device may be such that, instead of the hardness or elasticity requirement, the requirement is fulfilled that the second component has better optical properties than the first component, e.g. have a lower reflectivity or improved long-term black colour longevity, compared to the first component. In this embodiment the core component may be optimised for dimensional stability, stiffness and strength and the outer, second component may be optimised for avoiding reflections or highlights especially in sunlight. For the second component, a layer may be used provided with microstructures adapted to aid in trapping light, i.e. specific shapes may be provided for the microstructures for trapping of light. These microstructures, either regular or irregular, may be produced by roughening the surface, e.g. by laser processing as described above.

Figure 4:
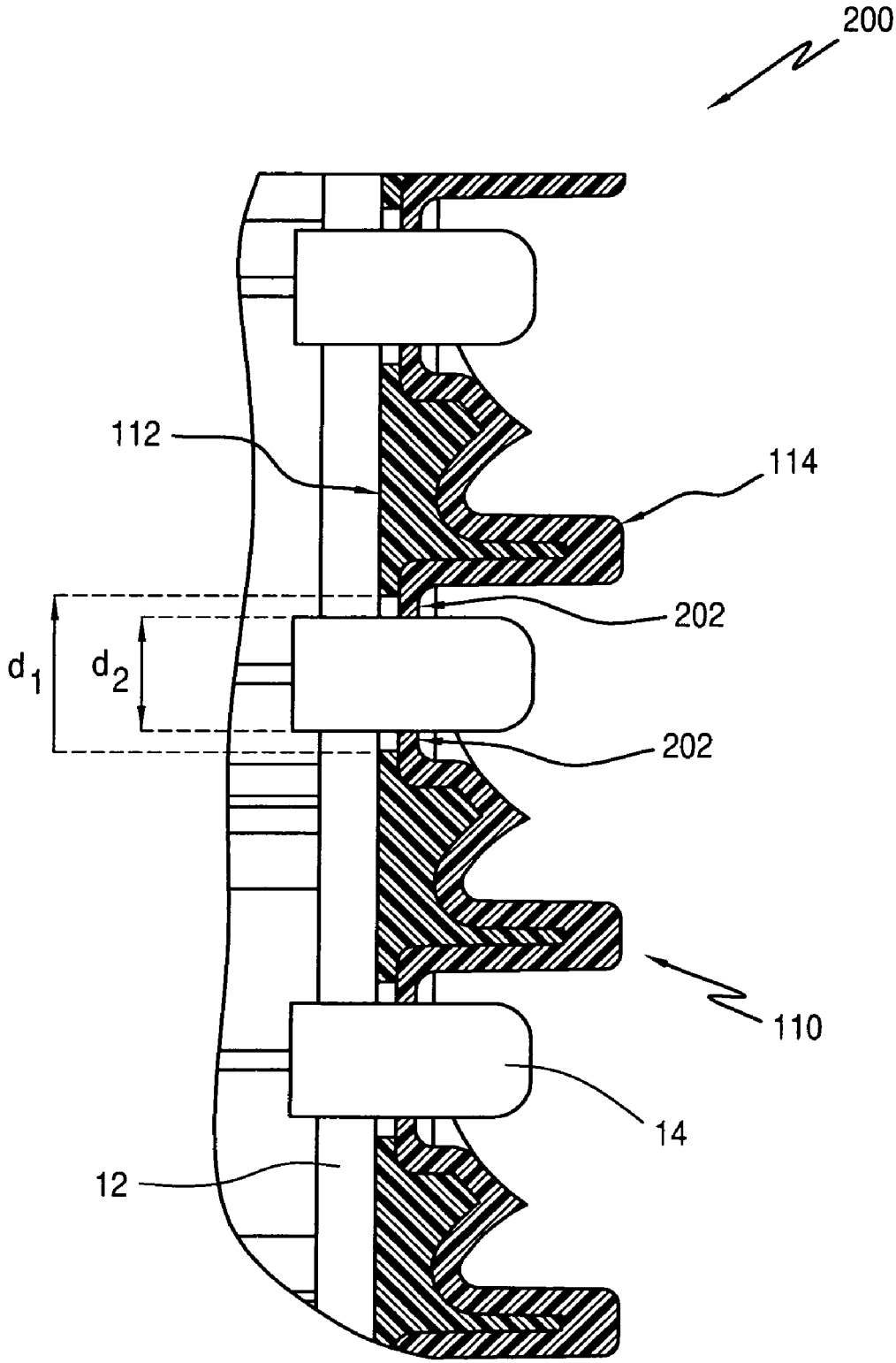
FIG. 4 is a cross-section of part of a display system with a shading device having a sealing function, according to a second embodiment of the present invention.

In a second embodiment, the present invention relates to a shading device as described in the first embodiment, but wherein the shading device is adapted for furthermore sealing the light sources and optionally the electronics of the display system for which it is used, from ambient, i.e. from environmental influences. The second embodiment thus comprises the same features and advantages as described in the first embodiment, but the second component 114 of the shading device is adapted for accommodating a plurality of light source units such that the second component is in sealing contact with the plurality of light source units. In this way the electronics and other components of the display system can be sealed from the environment or the ingress of environmental elements such as water can be reduced. The first component 112 of the shading device 110 preferably may be adapted for accommodating the plurality of light source units such that some degree of freedom exists for positioning the plurality of light source units relative to the shading device 110. The latter may be obtained by providing holes in the first component 112 that are substantially larger than the cross-section of the light source unit that needs to pass through that hole. The latter is advantageous as the first component 112 typically is a stiff material such that positioning the plurality of light source units relative to the first component can be performed without contact, i.e. in a contact-free way, between the light source units and the first component, thus avoiding damaging. The more flexible second component 114 is provided with holes that are of the same size or somewhat smaller than the light source units such that the flexible second component 114 is in contact with the light source units, once the two parts are positioned with respect to each other and such that this contact is a sealing contact for sealing the parts of the display system positioned under the light source units and the second component from the ambient of the display system. As the second component preferably is more elastic than the first component, the chance of damaging parts during mounting of these parts is substantially smaller. An example of such a shading device mounted on a display system 200 is shown in FIG. 4. It can be seen that the holes provided in the first, typically stiff, component 112 are larger than the holes in the second, typically more elastic, component 114. The latter is expressed by a diameter $d_1$ of the first component 112 being smaller than a diameter $d_2$ of the second component 114. In the present embodiment, the second component 114 thus typically shows edges 202 that are adapted for providing the sealing contact with the plurality of light source units, if the shading device is mounted in the display system.

In a third embodiment, the present invention relates to a shading device according to any of the previous embodiments, whereby the shading device furthermore is adapted for accommodating optical elements in front of the plurality of light source units. The latter may e.g. be an adaptation of the shape of the shading device such that optical elements can be positioned thereon, or may be a kind of clipping, clicking or clamping means for holding optical elements in front of a plurality of light source units. Such optical elements may e.g. be a diffracting element such as a lens or a diffraction grating, or maybe a filter such as a colour filter or a deflection device for directing the light in a direction or range of directions. Such optical elements are typically used for altering the properties of light that propagate through the elements to create desired enhancement effects or to create e.g. optimised full-motion video, magnified images, three-dimensional images, etc. A shading device according to this embodiment is shown as part of FIG. 5, indicating the additional optical elements 30.

Figure 5:
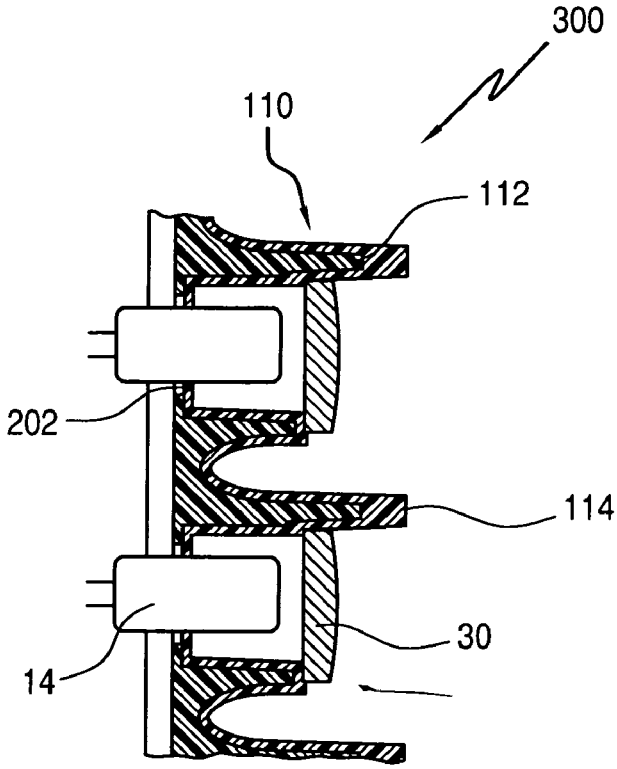
FIG. 5 is a cross-section of part of a display system with a shading device accommodating additional optical elements for the display system according to a third embodiment of the present invention.
Figure 6:
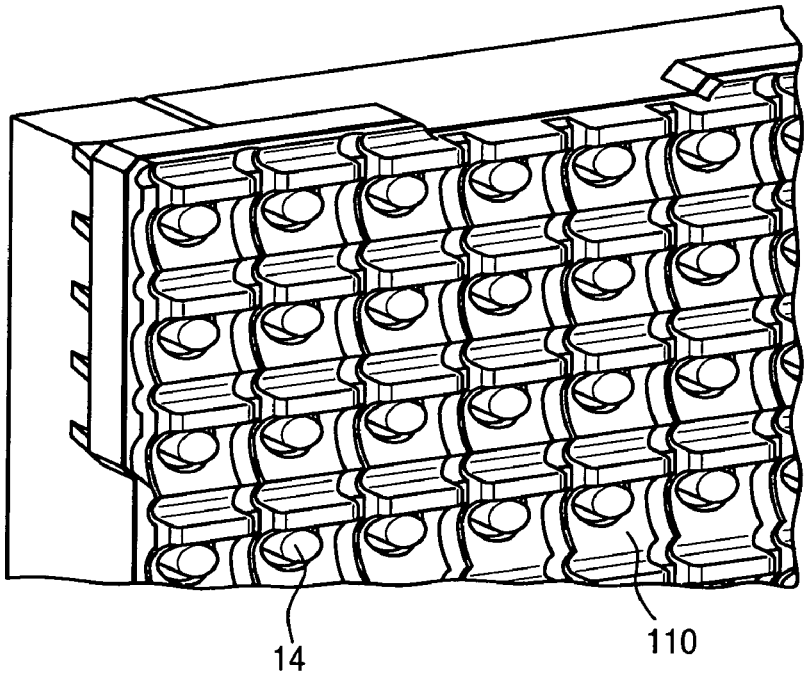
FIG. 6 is a perspective view of a display device comprising a shading device, according to a second aspect of the present invention.
Figure 7A:
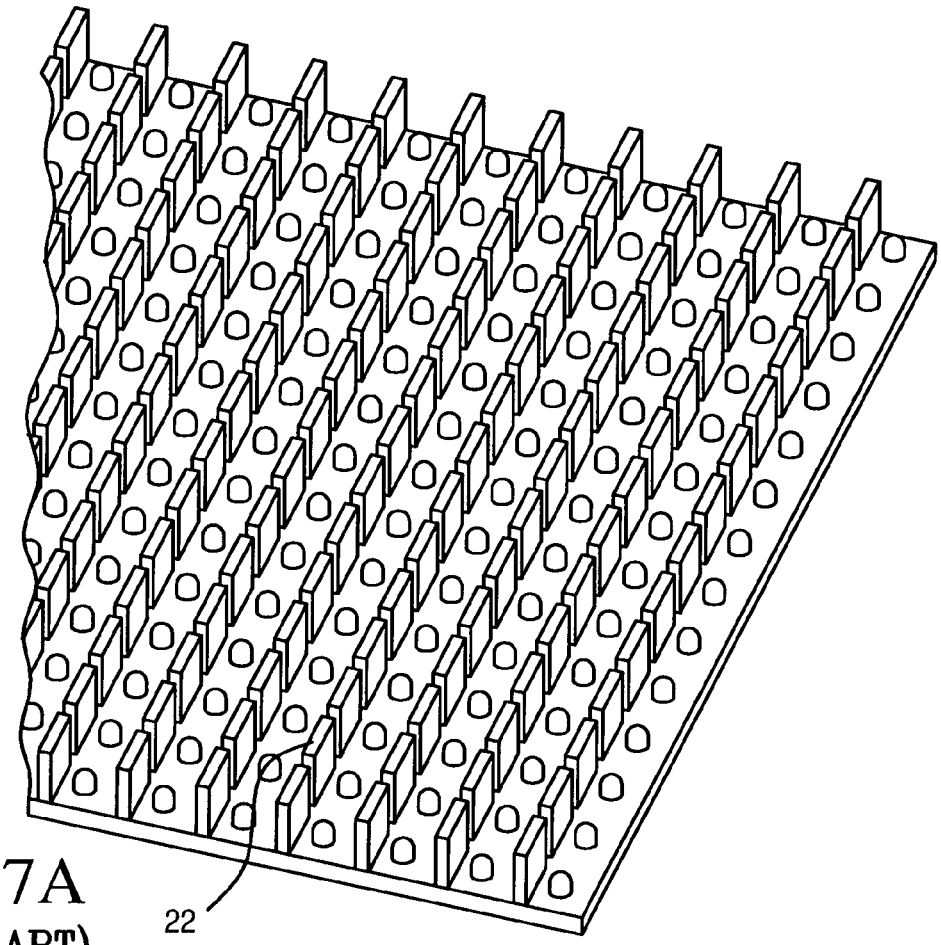
FIG. 7A (PRIOR ART)
FIGS. 7A and 7B are a comparison of a display device having a shading device as available from prior art and a shading device according to an embodiment of the present invention, respectively.
Figure 7B:
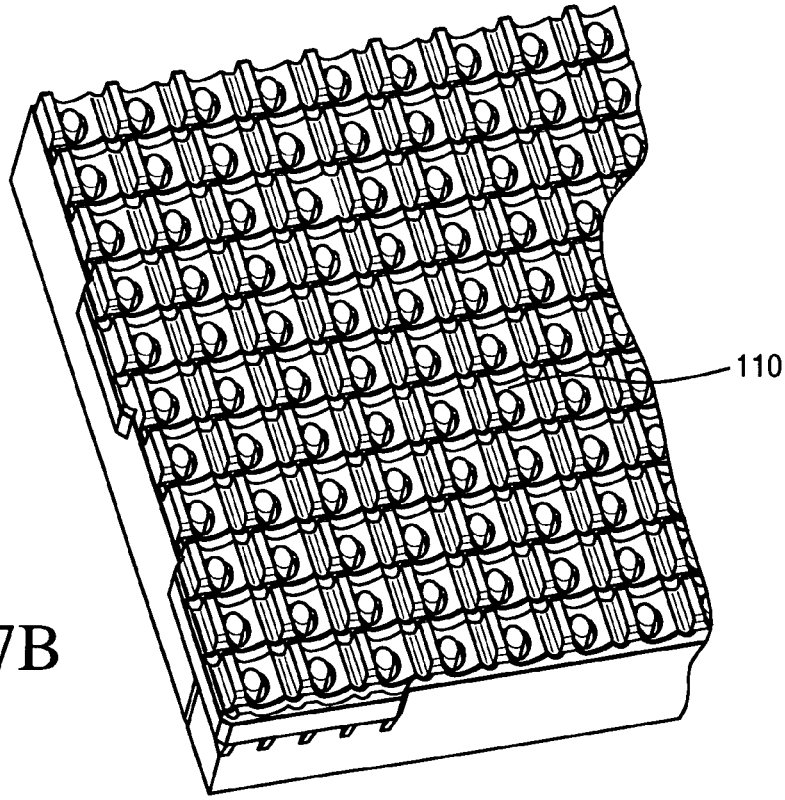

In embodiments of a second aspect, the present invention relates to a display system comprising a shading device according to any of the above described embodiments of the present invention. Display systems comprising shading devices are also illustrated in FIG. 2, FIG. 4 and FIG. 5. The display system 100, 200, 300 thus comprises a shading device 110 comprising a first component 112 that is a core component 112 and a second component 114 that is at least partly covering the core component 112. The second component 114 is a solid continuous layer covering the core component 112 and has a lower reflectivity than the core component. The second component 114 may be more elastic than the core component 112 and/or may have a lower hardness than the core component 112. For example it can be more flexible. Other features of the shading device 110 are described in more detail in the first, second and/or third embodiment of the first aspect of the present invention. The display system 100, 200, 300 furthermore typically comprises a plurality of light source units 14, wherein the light source units may e.g. be light emitting devices, such as light emitting diodes (LEDs) or organic light emitting diodes (OLEDs). The display system 100, 200, 300 may be suited for outdoor applications, such as outdoor advertising applications or outdoor displaying applications. Other features of the display system, e.g. as shown in FIG. 2, are as described in the previous embodiments. In particular embodiments, the shading device 110 of the display system is adjusted for sealing the light source electronics and remaining components of the display system 100, 200, 300 from the ambient of the display system 100, 200, 300 by providing a seal, i.e. a sealing contact between each of a plurality of light source units 14 of the display system 100, 200, 300 and the second component 114 of the shading device 110. Such a sealing contact may be obtained by providing holes for accommodating each of the plurality of light source units 14 that are equal to or slightly smaller than the cross section of the light source units 14 that needs to fit in these holes. In this way, once the shading device and the display systems are in position, each of the plurality of light source units 14 is surrounded by the second component such that for example, water, air or possible other environmental contamination sources cannot get in the display system from the side of the light source units 14. Further additional features of the display system may be as in prior art display systems. Part of a display system with a shading device is shown in FIG. 6, illustrating an upper perspective view of a display device comprising a shading device. FIGS. 7A and 7B show a comparison between a display device having a shading device according to prior art (FIG. 7A) and a shading device according to an embodiment of the present invention (FIG. 7B).

In a third aspect, the present invention relates to a method of manufacturing a display system with a shading device. The method is especially suitable for manufacturing display systems as described in the second aspect. The method comprises providing a bare display system, i.e. a display system without shading device or environmental sealing. The bare display system typically comprising a plurality of light source units. The method furthermore comprises providing a shading device comprising a first component and a second component having a lower reflectivity than the first component. The first component may be a rigid component and the second component may be a more elastic or flexible and/or a less hard component. The light source units can extend in one direction from one side of an electronic component substrate such as a Printed Circuit Board. The bare display system may be in the form of a tray with a shading device according to any of the embodiments of the present invention forming the bottom of the tray. The electronic component substrate fits into the tray with the light source towards the shading unit. The method furthermore comprises pushing the shading device onto the bare display system such that the plurality of light source units of the bare display system are inserted through holes in the first component and pushed in holes of the second component of the shading device, such that the second component is in sealing contact with the plurality of light source units. Preferably the holes in the first component are chosen substantially larger than the cross-section of the light source units that need to pass the holes, such that no contact between the light source units and the first, typically rigid component of the shading device. The holes in the second component of the shading device are chosen such that they are equal to or slightly smaller than the cross section of the light source units that need to be pushed in the holes, resulting in the sealing contact. The method for manufacturing a display system furthermore may comprise fixing the shading device and the bare display system to each other using e.g. any one or a combination of gluing, clipping means, clicking means or clamping means. The method according to the present embodiment provides an efficient way of manufacturing a display system comprising both a means for shading and a means for sealing. As only the second component of the shading device needs to be in contact with the light source units and as this second component typically is relatively elastic, the risk for damaging the light source units or the shading device is avoided.

It is to be understood that although preferred embodiments, specific constructions and configurations, as well as materials, have been discussed herein for devices according to the present invention, various changes or modifications in form and detail may be made without departing from the scope and spirit of this invention. For example, whereas the above embodiments of the first and second aspect relate to a shading device and display system comprising such a shading device, the present invention also relates to the corresponding methods for shading a display system.

The invention claimed is:

1. A shading device for shading a display system using light sources, the shading device comprising a first component and a second component, the first component being a reflective core component and the second component at least partly covering the reflective core component, the first and second components including aligned apertures arranged to receive display system light sources when installed with a display system, wherein the second component is a solid continuous layer having a reflectivity that is lower than the reflectivity of the core component, and comprises shading portions shaped and arranged to block ambient light approaching the apertures of the shading device at predetermined angles of ambient light incidence when the shading device is installed with a display system.

2. The shading device according to claim 1, wherein the second component is made of black material.

3. The shading device according to claim 1, wherein the second component is roughened to reduce its reflectivity.

4. The shading device according to claim 1, wherein the second component includes a layer provided with a microstructure that reduces reflectivity.

5. The shading device according to claim 4, wherein the second component comprises a film provided with particles.

6. The shading device according to claim 5, wherein the particles are sputtered onto the film.

7. The shading device according to claim 1, wherein the first component has a first elasticity and flexibility, and the second component has a greater elasticity or flexibility than the core component.

8. The shading device according to claim 7, wherein the second component comprises an elastomeric material and/or a plastic such as polyamide.

9. The shading device according to claim 7, wherein the second component comprises a thermoplastic elastomer material.

10. The shading device according to claim 1, wherein the second component comprises a region with a thickness of at least 0.5 mm.

11. The shading device according to claim 1, wherein the second component is tandem- or co-moulded with said first, core component.

12. The shading device according to claim 1, wherein said apertures are configured so that the second component will be in sealing contact with said plurality of light sources when said light sources are received in said apertures.

13. The shading device according to claim 1, wherein said second component is made of an anti-electrostatic material.

14. The shading device according to claim 1, wherein said shading device is adapted for supporting optical elements for said display system.

* * * * *